United States Patent [19]

Ellman et al.

[11] Patent Number: 4,835,874

[45] Date of Patent: Jun. 6, 1989

[54] DRIVEN MARKING SYSTEM FOR CREATING A PLURALITY OF VARIED LINE DESIGNS

[76] Inventors: Steven Ellman; Fred Ellman; Julius Ellman, all of 1672 E. 7th St., Brooklyn, N.Y. 11230; George Lerner, 14820 Naran-Ja Lakes Blvd., Naran-Ja, Fla. 33032

[21] Appl. No.: 140,824

[22] Filed: Jan. 5, 1988

[51] Int. Cl.[4] ..... B43L 11/00

[52] U.S. Cl. ..... 33/27.11

[58] Field of Search ..... 33/27.11, 27.01, 27.1, 33/27.1 W, 18.1, 23.11

[56] References Cited

U.S. PATENT DOCUMENTS

| | | | |
|---|---|---|---|
| 3,256,606 | 6/1966 | Horta | 33/27.11 |
| 3,297,003 | 1/1967 | Benson | 33/27.11 X |
| 3,390,460 | 7/1968 | Brown et al. | 33/27.01 |
| 3,872,596 | 3/1975 | Pardubsky | 33/27.11 |
| 4,117,598 | 10/1978 | Fisher | 33/27.11 |
| 4,441,256 | 4/1984 | Cummings et al. | 33/27.11 |

FOREIGN PATENT DOCUMENTS

| | | | |
|---|---|---|---|
| 1470756 | 2/1967 | France | 33/27.11 |

*Primary Examiner*—William D. Martin, Jr.
*Attorney, Agent, or Firm*—Lackenbach Siegel Marzullo & Aronson

[57] ABSTRACT

A hand-held marking device for drawing upon a paper or other surface. The device includes a housing having a hole opening to the surface and enclosing a motor, batteries for the motor, and a switch. The motor drives a gear train, which includes a pinion gear axially connected with the motor and a spur gear geared with the pinion gear. A holder gripping a pencil or pen is positioned over the hole so that the holder rotates about a horizontal pivot pin downward so that the pen or pencil comes into contact with the paper or surface to be marked by force of gravity. The paper is in a horizontal plane and the pen is in a vertical orientation. The holder is secured to the inner rim of the spur gear. The swivel member can be aligned into one of a plurality of locking recesses along an arced groove eccentrically oriented relative the center of the spur gear. When the motor is turned on and the marking device is moved manually, the pen draws a continuous spiral. Another embodiment includes a template having one of a plurality of possible cutout configurations removably connected to the bottom of the housing.

12 Claims, 7 Drawing Sheets

DRIVEN MARKING SYSTEM FOR CREATING A PLURALITY OF VARIED LINE DESIGNS

FIELD OF THE INVENTION

This invention relates generally to a hand-held marking device and more particularly to a powered marking device capable of drawing a repetitive design.

BACKGROUND OF THE INVENTION

Hand-held marking devices that are driven, for example, by a battery powered motor and are capable of drawing selected design such as a circle, are known in the art. Patents that have been granted on this type of device include the following:

U.S. Pat. No. 3,297,003 issued Jan. 10, 1967 to B. S. Benson, entitled "Pencil or Pen With a Moving Point";

U.S. Pat. No. 209,112 issued Oct. 31, 1967 to H. A. Plassman and F. H. Sedris; and U.S. Pat. No. 3,997,972 issued Dec. 21, 1967 to J. V. Jaunaraja.

Non-powered marking devices in the field of the present invention include U.S. Pat. No. 2,390,226 issued Dec. 11, 1945 to J.P. Smith; U.S. Pat. No. 2,805,475 issued Sept. 10, 1957 to H. K. Adams; and U.S. Pat. No. 2,095,116 issued Oct. 5, 1937 to J. S. Albin.

U.S. Pat. No. 3,297,003 to Benson discloses an elongated housing having a bore that contains a marking member positioned between a surface to be marked surface at one end of the housing. The marking member is coextensive with a movable eccentric. A circular narrowed portion, or fulcrum, positioned between the eccentric and the surface to be marked pivotably supports the marking member. A guide means having a wall forming a noncircular opening contacts the marking member during its rotation and confines the marking member so as to produce noncircular decorative markings to the surface to be marked.

It is apparent that the Benson invention reveals several problems on its face. One is that the tip of the marking member is constantly changing angle with the marking surface. As the operator moves the device along the surface to be marked, the tilt of the marking member as it rotates will cause alternate retarding and sliding forces of the marker member tip relative to the paper and the movement of the device by the operator. Another problem is that the length of the marking member can only be a ball-point pen or an analogous instrument because there is no provision for adjusting the length of the marking member in the housing. This requirement eliminates graphite, colored, felt tip, and other such marking members. Another problem is that a marking member of only one size and length can be mounted in the housing. Provision for replacement of a worn-out ballpoint pen with a new pen is not set forth in the disclosure.

SUMMARY OF THE INVENTION

Accordingly, it is an object of this invention to provide a hand-held, power-driven system for marking a surface with a repeated configuration which allows a continuous pressure of a marking member against the surface to be marked.

It is another object of this invention to provide a hand-held, power-driven system for marking a surface with a repeated configuration that is variable in size by adjustment of a marking member relative to the housing.

It is another object of this invention to provide a hand-held, power-driven device for marking a repeated configuration upon a surface to be marked which allows easy replacement of one marking member with any of other marking members of different colors and sizes of marking member tips.

It is still another object of this invention to provide a hand-held, power-driven system for marking a repeated configuration upon a surface to be marked that directs the tip of a marking member generally vertically against the horizontal plane of the surface to be marked.

It is yet another object of the present invention to provide a hand-held, power-driven device for marking repeated configurations that rotates a marking member in a smooth, continuous manner generally vertical to a generally horizontal surface to be marked so that as the hand-held device is moved over the surface to be marked no alternate resisting and adding pressures are generated relative to the direction of the movement of the appliance over the surface to be marked.

In accordance with these and other objects that will become apparent hereinafter, there is provided a hand-held marking device for drawing upon a paper or other surface. The device includes a housing having forward and rearward housing portions with the rearward housing portion having a hole opening to the surface and the forward portion enclosing a motor, batteries for the motor, and a switch extending from the domed head portion of the forward housing portion. The motor drives a gear train, which includes a pinion gear axially connected with the motor, an intermediate gear geared to the pinion gear, and a spur gear geared with the intermediate gear. The spur gear is ring-shaped with the ring aligned with the hole in the rearward housing portion. A holder removably gripping a pencil or pen is positioned over the hole so that the holder rotates downward about a horizontal pivot pin so that the pen or pencil comes into contact with the paper or surface to be marked by force of gravity. The paper is in a horizontal plane and the pen is in a vertical orientation. The holder is secured to a swivel member attached to a ledge extending from the inner rim of the spur gear. The swivel member has a pointed tip with a locking pin that can be snapped into one of a plurality of locking recesses along an an arced groove eccentrically oriented relative the center of the spur gear. Each locking recess positions the holder and the pen in a different radial distance from the center of the spur gear. When the motor is turned on and the marking device is moved manually, the pen draws a continuous spiral.

Another embodiment of the marking device includes a replaceable template having a shaped cutout having an edge is removably set in a recess in the flat bottom wall of the rear housing of the marking device under the circular hole. A biasing spring presses the holder and thus the marking member against the edge of the template cutout.

The present invention will be better understood and the main objects and important features will become apparent when consideration is given to the following details and description, which, when taken in conjunction with the annexed drawings, describes, discloses, illustrates, and shows the preferred embodiments or modifications of the present invention and what is presently considered and believed to be the best mode of practice in the principles thereof. Other embodiments or modifications may be suggested to those having the benefit of the teachings herein and such other embodiments or modifications are intended to be reserved especially as they fall within the scope and spirit of the subjoined claims.

DESCRIPTION OF THE PREFERRED EMBODIMENT

Figure 1:
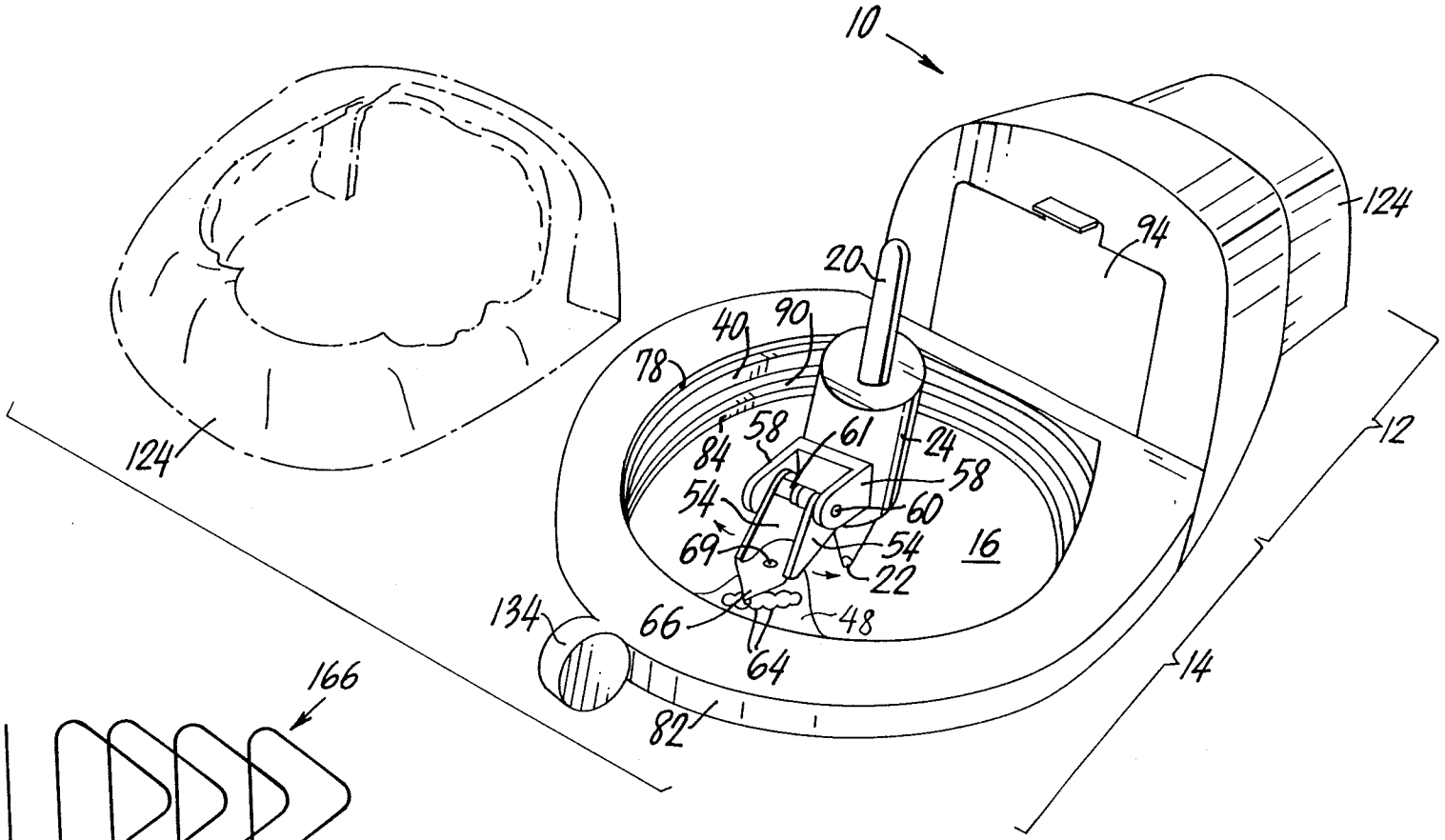
FIG. 1 is a perspective view of the marking system.
Figure 16:
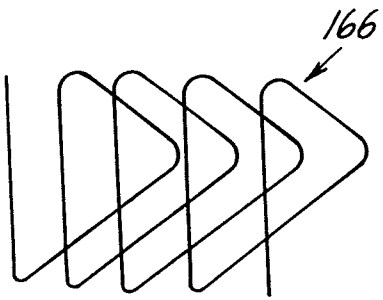
FIG. 16 illustrates a triangular line generated by the marking device.

Reference is now made in detail specifically to the drawings in which identical or similar parts are designated by the same reference numerals throughout the verious views.

Figure 2:
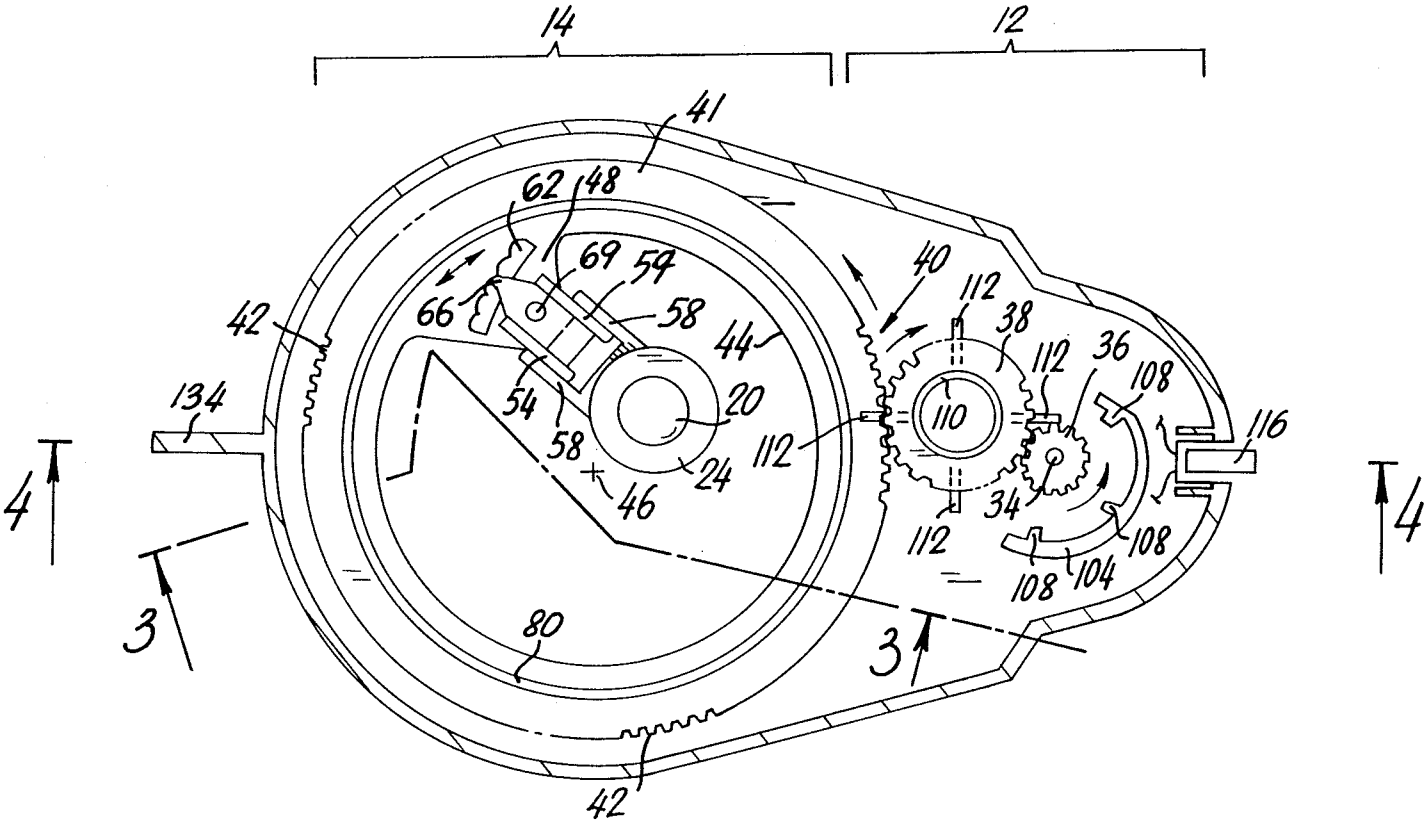
FIG. 2 is a cutaway top view of the marking system illustrating in particular the drive gearing and the marking member.
Figure 3:
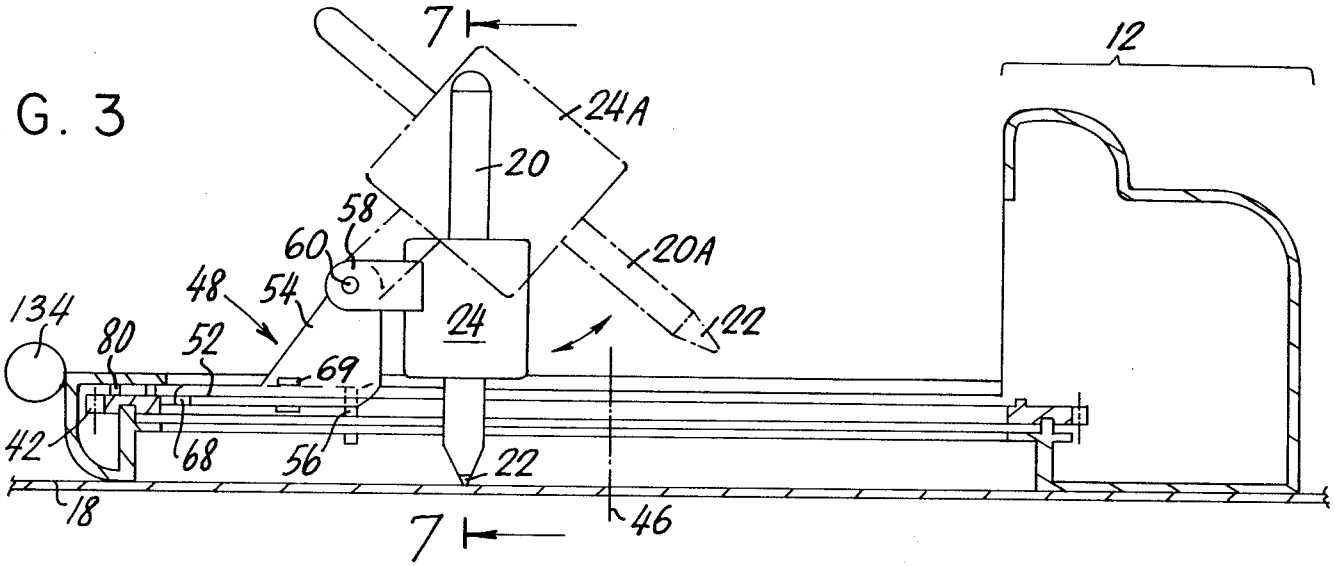
FIG. 3 is a sectional side view of the marking system taken through a line 3—3 in FIG. 2.
Figure 4:
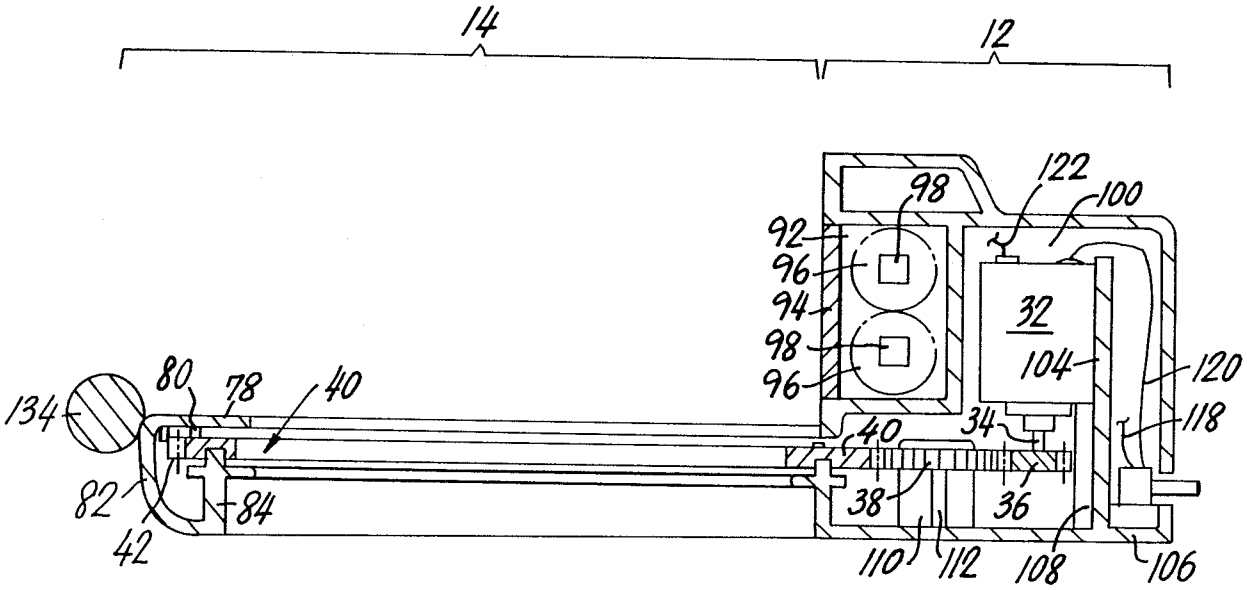
FIG. 4 is a sectional side view of the marking system taken through a line 4—4 in FIG. 2.

A marking device 10 of such size that it is capable of being readily held and manipulated by hand is illustrated in perspective view in FIG. 1, in top view in FIG. 2, and in sectional views in FIGS. 3 and 4. Device 10 includes a housing including forward and reaward housing portions 12 and 14, respectively, which are preferably made of plastic.

Figure 7:
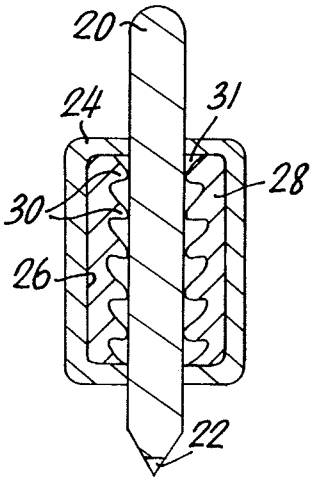
FIG. 7 is a sectional view taken through line 7—7 in FIG. 3.
Figure 6:
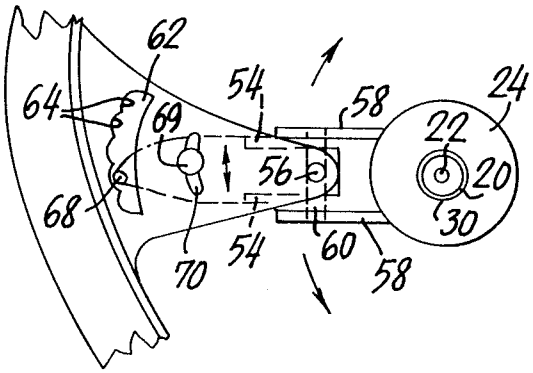
FIG. 6 is a bottom view of the marking member holder.

Rearward housing portion 14 forms a central circular hole 16 opening to a surface to be marked, such as a piece of paper 18 (FIG. 3). A marking member, preferably a pencil, crayon, or, as illustrated by way of exposition, a felt pen 20, which has a felt marking tip 22, is positioned in a cylindrical pen holder 24 (FIG. 7), which forms an elongated compartment 26 in which pen 20 is positioned. Holder 24 includes a rubber insert 28 positioned in compartment 26 that has a number of circular grips 30 forming an axial passage 31 in which pen 20 is removably retained. Grips 30 are in biased relationship with pen 20 when pen 20 is positioned in compartment 26. Pen 20 is manually removable from grips 30 and from compartment 26. Holder 24 is positioned over circular hole 16, which opens to paper 18, so that pen 20 extends transversely through the plane of circular hole with felt tip 22 in operative marking contact with paper 18. Paper 18 is in a horizontal plane and pen 20 is in a vertical orientation.

A motor 32 positioned in forward housing portion 12 as illustrated in FIG. 4 has a drive shaft 34, which extends vertically downward in the operative mode. A system of driving gears illustrated in FIG. 4 is linked to motor 34 is positioned directly below motor 32. Pinion gear 36 meshes with a horizontal ring-shaped intermediate gear 38 which in turn is meshed with a horizontal spur gear 40, which is rotatably positioned in rearward housing portion 14. Spur gear 40 is configured as a gear ring 41 having an outer rim having gear teeth 42 and inner rim 44 defining a circular hole having an axial center 46 which is coextensive with the center of circular hole 16. Pen 20 is spaced from and oriented parallel to axial center 46. Spur gear 40 is oriented in a horizontal plane in the operative mode of device 10 as illustrated in FIGS. 1–4 as are pinion gear 36 and intermediate gear 38.

In the top view illustrated in FIG. 4, pinion gear 36 is rotated counterclockwise, intermediate gear 38 is rotated clockwise, and spur gear 40 is rotated counterclockwise. Motor 32 is rotated at a continuous rate of speed so that spur gear 40 is likewise rotated at a continuous rate of speed.

As illustrated in FIGs. 1, 2, 3, and 6, a ledge 48 connected to inner rim 44 of spur gear 40 extends inwardly into hole 16 transverse to the axis of spur gear 40. A swivel member 50 includes a flat portion 52 parallel to and flush with the top side of ledge 48 and a pair of spaced support members 54 connected to and extending upwardly from flat portion 52. Flat portion 52 extends horizontally as does ledge 48 when device 10 is in the operative mode as illustrated in FIGS. 1–4. Swivel member 50 is rotatably connected to ledge 48 by a pivot pin 56, which is connected to the bottom side of flat portion 52 and extends through a pivot hole in ledge 48. Pivot pin 56 is parallel to axis 46 of spur gear 40.

A pair of horizontally extending spaced arms 58 extending transversely from the cylindrical side of holder 24 enclose upwardly extending support members 54. A pivot pin 60, which is spaced above and is parallel to the plane of spur gear 40. Extends through both arms 58 and support members 54 so that holder 24 is rotatably movable about pivot pin 60 in a plane normal to the plane of spur gear 40 between a downward operative position as illustrated in FIG. 4 where pen 20 is in its vertical position transverse to horizontal paper 18 and an upward non-operative position as indicated in phantom line by holder 24A and pen 20A where pen 20 is angled to paper 18. A horizontal spacer 61 extending between arms 58 encloses horizontal spacer 61 extending between arms 58 enclosed horizontal pin 60. Holder 24 is of such a weight that in combination with the weight of pen 20 a force of gravity exists sufficient to press tip 22 into operative drawing relationship with paper 18.

Ledge 48 has an arced groove 62 wich is radially centered at vertical pivot pin 56. Arced groove 62 is oriented eccentrically with respect to inner rim 44. The outer side of arced groove 62 has five rounded locking recesses 64. Flat portion 52 of swivel member 50 has a pointed tip 66 having a downwardly extending, or vertically extending, locking pin 68 parallel to pivot pin 56. When swivel member 50 is rotated about pivot pin 56, locking pin 68 is moved along locking recesses 64 and is placed into biased locked relationship with a selected one of the five locking recesses 64 and is removed from the selected locking recess by rotational manual pressure applied at holder 24 into another selected locking recess. The material of ledge 48 is a biasable plastic so that locking pin 68 can be snap-mounted into and removed from each selected locking recess 64. Because of the eccentric orientation of arced groove 62, each of the five locking recesses 64 are positioned at different distances from axial center 46, so that holder 24 and pen 20 are likewise moved along an arced path relative to inner rim 44, with the result that pen 20 can be moved in a horizontal arc eccentric to axial center 46 and thus can be locked at a selected one of five different radial distances from axial center 46. A securing pin 69 lateral to locking pin 68 extends through flat portion 52 of swivel member 48 and ledge 48 with flattened pin ends at the top surface of flat portion 52 and the bottom surface of ledge 48. Securing pin 69 extends through an arced groove 70 (FIG. 6) which is concentric with arced groove 62 and which allows securing pin 69 to swing as swivel member 50 is swung when pointed tip 66 is being aligned with a selected recess 64.

Figure 8:
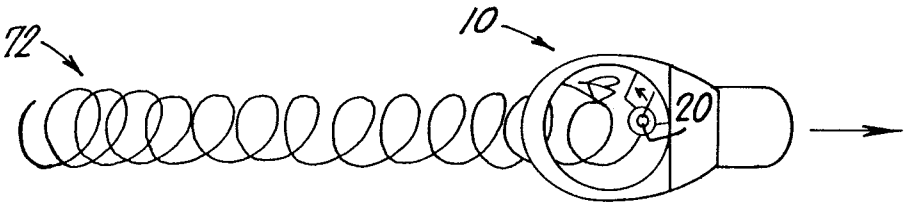
FIG. 8 illustrates the markings made by the marking device when the marking member is positioned at its largest circular configuration.
Figure 9:
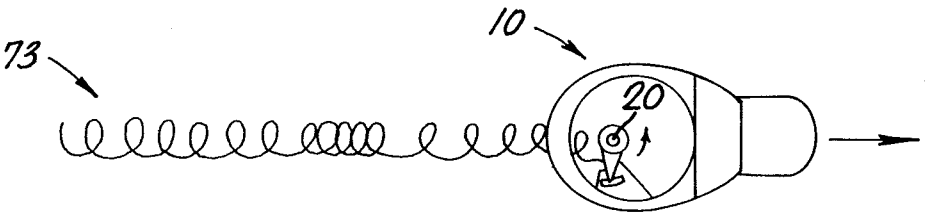
FIG. 9 illustrates the markings made by the marking device when the marking member is positioned at its smallest circular configuration.

When marking device 10 is stationary and motor 32 is operative and holder 24 is in its operative mode, pen 20 will draw a circle upon paper 18 at any selected one of five radial distances from axial center 46 in accordance with the selected locking recess of the five locking recesses 64. When device 10 is simultaneously moved along paper 18, pen 20 will draw a spiral configuration upon paper 18, as is illustrated in FIGS. 8 and 9, which show spirals 72 and 73, respectively, formed from circles of greater and lesser radii, respectively, as motor 32 rotates spur gear 40 and device 10 is simulteneously manually slid forward upon paper 18. Spirals 72 and 73 are configured close together or spread apart in accordance with the speed of manual movement of device 10.

Figure 5:
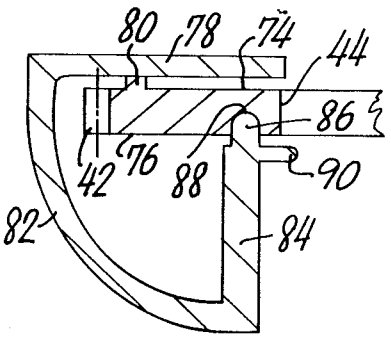
FIG. 5 is a detail of the joining of the main drive gear with the body of the housing.

As seen best in FIG. 5, gear ring 41 of spur gear 40 has opposed flat top and bottom sides 74 and 76, respectively. Rearward housing portion 14 includes a circular top wall 78 disposed over top side 74, which has a circular ridge 80 extending upwardly into sliding contact with the underside of top wall 78 so that the remainder of top side 74 is spaced from top wall 80. Rearward housing portion 14 includes a circularly curved side wall 82 that curves downwardly from connection to top wall 80 to a position under gear ring 41 where a circular wall 84 extends transversely upwardly terminating with a circular track 86 that fits into a circular groove 88 formed around bottom side 76 of gear ring 41. Side wall terminates at forward housing portion 12. Spur gear 40 rides upon track 86 during operation of device 10. An inwardly extending protective circular flange 90 extends inwardly from the inner side of circular wall 84.

Forward housing portion 12 as shown in FIG. 4 includes battery compartment 92 having an aperture opening toward rearward housing 14 and including a removable battery door 94 removably positioned in said aperture. A pair of vertically stacked batteries 96 shown in phantom line are positioned in compartment 92. Battery contacts 98 are disposed on the side walls of compartment 92. Motor is located forward of battery compartment 92 in a motor compartment 100, which is generally vconfigured as an elliptical dome. Drive shaft 34 is axially connected to horizontal pinion gear 36. A semicircular wall 104 extending upwardly from a bottom wall 106 of forward housing portion 12 extends around the forward area of motor 32. Three vertical support ribs 108 connected to the inner side of semicircular wall 104 have top edges that support motor 32. A circular support wall 110 has a diameter slightly smaller than the inner diameter of the ring of intermediate gear 38 so that intermediate gear 38 fits closely around support wall 110. Four vertical ribs 112 connected to the outer side of circular wall 110 terminate in top edges that rotatably support intermediate gear 38 by way of a circular ridge (not shown) extending from the surface of intermediate gear 38.

Forward housing portion 12 includes a generally dome-shaped head portion 114. A notor on-off switch 116 is positioned in cutout at the lower front center of head portion 114. Electrical wires 118 and 120 extend from switch 116 to batteries 96 and motor 32, respectively, and electrical wire 122 extends between batteries 96 and motor 32 to create an electrical circuit.

A transparent dome 124, which is ordinarily placed in a protective position on top wall of wall 78 or rearward housing portion 14, is illustrated in a removed position in FIG. 1. Dome 124 has a curved top wall having a cutout 126 to allow rotating movement of pen 20. Dome 124 is preferably made of transparent plastic. A cylindrical handle 134 for dripping and directing device 10 is connected to rear of top wall 78 of rearward housing 14.

Figure 10:
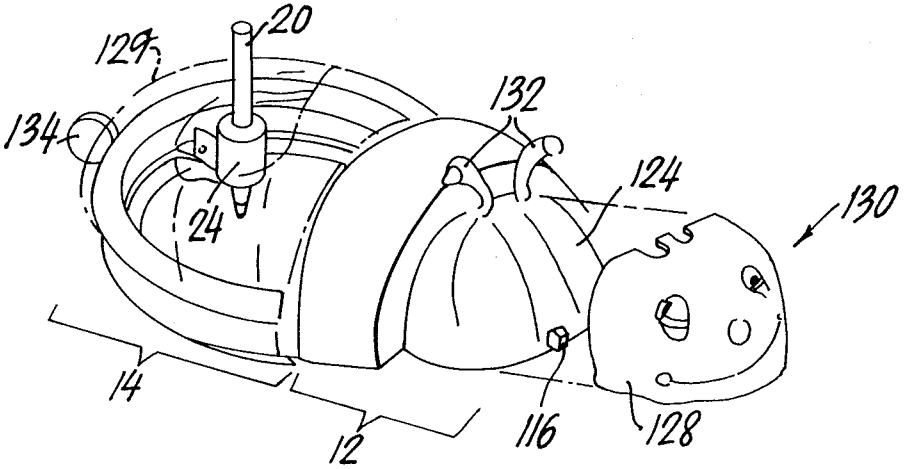
FIG. 10 is a perspective view of the marking device with a decorative mask shown in a removed position.
Figure 11:
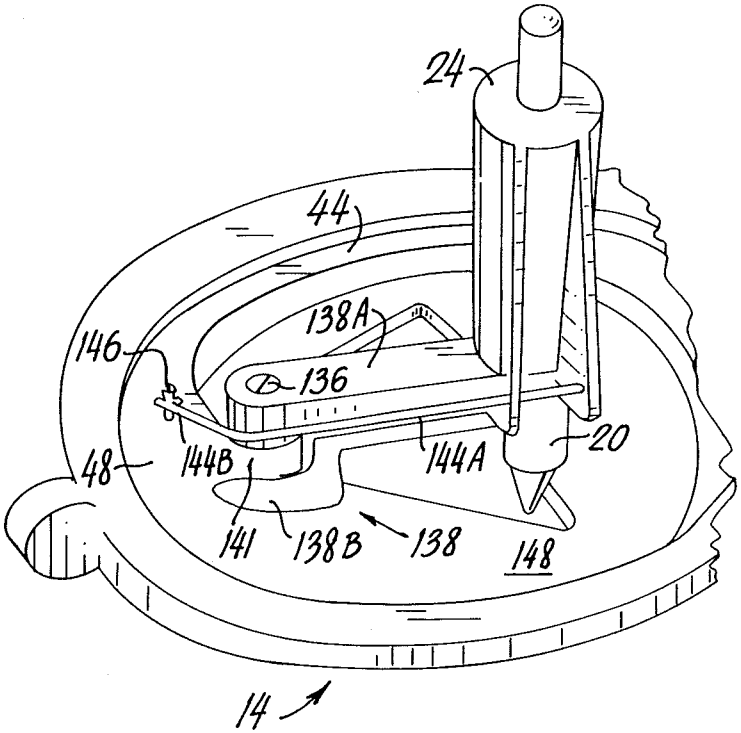
FIG. 11 is a fragmented perspective view of another embodiment of the marking device.
Figure 12:
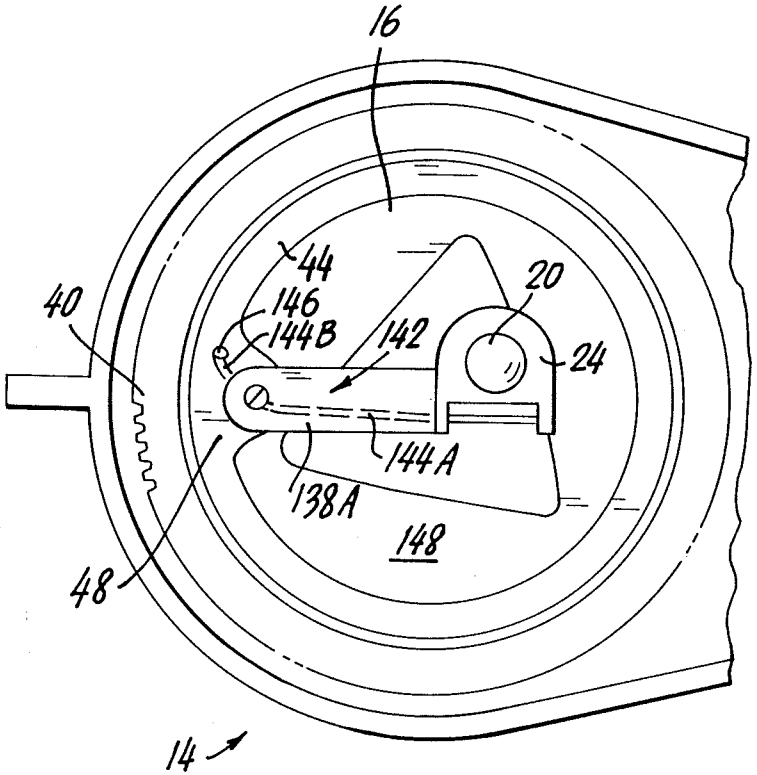
FIG. 12 is a top view of the embodiment illustrated in FIG. 11 analogous to the top view of the first embodiment as illustrated in FIG. 1.

A decorative mask 128 illustrated in a removed position in FIG. 10 is optionally fitted over dome-shaped head portion 114. Mask 128 is decorated such as with cartoon face 130. Decorative antennae 132 are optionally connected to the top of forward housing portion 12.

In operation, pen 20 is inserted into holder 24 and device 10 is placed over paper 18 or other surface to be marked, which is to be generally horizontal in orientation. Swivel member 50 is rotated so that pointed tip 66 along with locking pin 68 is snapped into the selected locking recess 64. Holder 24 is allower to rotate about pivot pin 60 upon paper 18 so that tip 22 is placed in operative marking contact with paper 18 by force of gravity. Switch 116 is turned on so that motor 32 is activated to rotate spur gear 40 with holder 24 so that pen 20 draws a circle upon paper 15. Device 10 is then manually move forward, sideways, or rearward so that spirals analogous to spirals 72 and 73 of FIGS. 8 and 9 are drawn.

Another embodiment of the invention is illustrated as marking device 135 in FIGS. 11–16. Holder 24 is rotatably connected via swivel member 138 comprising upper and lower swivel portions 138A and 138B to spur gear 40. A vertical pin 136 generally parallel with elongated holder 24 and pen 20 extends through a pair of vertically aligned pin holes formed in upper and lower swivel portions 138A and 138B at locations spaced from holder 24. Ledge 48 extends laterally into central hole 16 from the inner rim of spur gear 40 between upper and lower swivel portions 138A and 138B, which are connected to mounting portion 140. Ledge 48 forms a pin hole aligned with the pin holes of upper and lower swivel portions 138A and 138B. Ledge 48 includes a boss 141 that extends above the horizontal plane of the top surface of spur gear 40. Ledge 48 including boss 141 forms a vertical bore axially aligned with the pin holes of upper and lower swivel portions 138A and 138B. Pin 136 also extends through the bore of ledge 48 so as to rotably mount holder 24 by way of swivel 138. Pin 136 has a lower pin head that is wpwardly pressed against the bottom surface of lower swivel portion 138B; pin 136 also forms upper threads adapted to receive a nut that is threaded downwards onto the mentioned threads to pressing engagement with the top surface of ledge 48, specially the top surface of boss 141. A torsion spring 142 includes inner and outer spring prongs, or arms, 144A and 144B, respectively, forming a turnaround hollow between arms 144A and 144B. Pin 136 extends through the Spring hollow, which in turn is mounted around boss 141. Inner spring arm 144A extends from boss 141. Inner spring arm 144A extends from boss 141 to the outer wall of holder 24 in top view, seen best in FIG. 11. Outer spring arm 144B extends from boss 141 to a bracing post 146 extending upwardly from the top surface of spur gear 40, seen in FIGS. 11 and 12.

Figure 13:
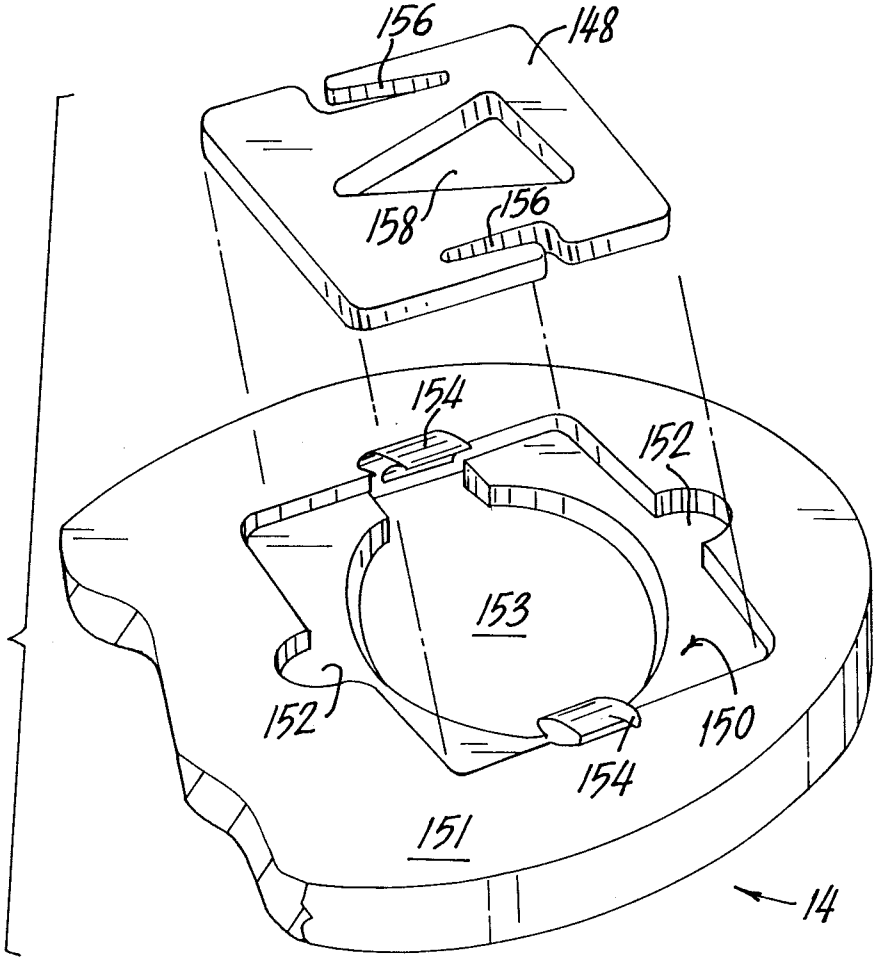
FIG. 13 is a fragmented, exploded perspective view of the bottom of the marking device illustrated in FIG. 11 including a template with a triangular cutout.
Figure 14:
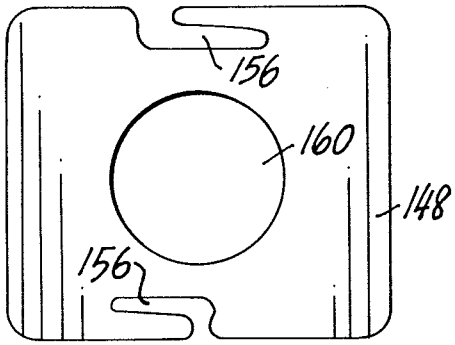
FIG. 14 is a top view of a template having a circular cutout.
Figure 15:
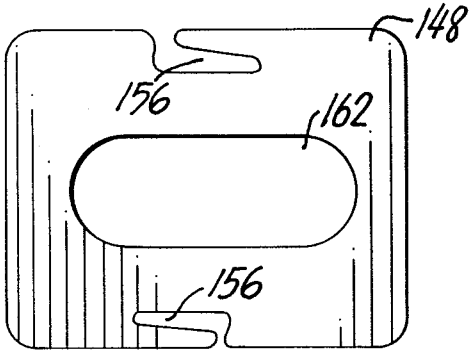
FIG. 15 is a top view of a template having an ovular cutout.

A square template 148 seen best in the bottom view of rearward housing portion 14 in FIG. 13 is removably mounted to the bottom of rearward housing portion 14, which forms a wquare recess 150 adapted to receive template 148. Additional half-circular recesses 152 are located at front and rear portions of recess 150 for the purposes of providing finger access for removing template 148. Also, a pair of snap-in connectors 154 are positioned at opposite sides of recess 150. Connectors 154 each include a vertical portion that is secured to the bottom side edge of rearward housing portion 14 forming recess 150; a biasable horizontal portion connected to the vertical portion and occupying a plane co-extensive with the flat bottom wall 151 of rearward housing portion 14 and having an inward curved edge; and a curved gripping portion attached to the curved edge of the biasable portion and that extends back under the biasable portion, the curved edge having an upwardly disposed flange. An aperture 153 is formed in bottom wall 151.

Template 148 forms a pair of oppositely positioned slots 156 aligned along the sides of template 148 that are adapted to receive the curved gripping portions of snap-in connectors 154. Template 148 has a cutout 158, shown here as an equilateral triangle, which is smaller than and generally centered in alignment with aperture 153.

The configuration of cutout 158 of template 148 as a triangle is by way of illustration only. Many other cutout configurations are possible. Two other cutout configurations of a possible plurality of configurations are illustrated by way of example in FIGS. 14 and 15, which illustrate a circular cutout 160 and an oval cutout 162, respectively. Either template 160 or 162 can be substituted for template 148 illustrated in fig. 13 in accordance with the desire of the user.

Sour gear 40 is rotated by way of intermediate gear 38 in a counterclockwise direction so that ledge 48 and swivel 138 are rotated counterclockwise also. Swivel 138 rotates freely about pin 136. Spring 142 biases holder 24 in a direction perpendicular to inner arm 144A against the wall of cutout 158, which pressures holder 24 and in particular pen 20 against the edge of cutout 158 so that holder 24 is carried in a triangular movement as is pen 20 so that a triangular line is traced on paper 18. When a user pulls or pushes marking device 135, the marking line becomes a continuous series of triangles 166 generally approximated in FIG. 16. There are a plurality of possible lines depending upon the direction and speed of the hand movements of the user directing marking device 135 and line 166 is morely one line by way of exposition.

The embodiment of the invention particularly disclosed and described hereinabove is presented merely as an example of the invention. Other embodiments, forms, and modifications of the invention coming within the proper scope and spirit of the appended claims will, of course, readily suggest themselves to those skilled in the art.

What is claimed is:

1. A system for marking a surface, comprising, in combination, a housing forming a hole opening to said surface, marking means for drawing upon the surface, holder means positioned in said hole for removably gripping said marking means, gear means rotatably mounted to said housing and connected to said holder means, said gear means being for rotating said holder means about said hole, drive means for rotating said gear means, and power means for energizing said drive means, said holder means including pivot means for joining said holder means to said gear means so that said holder means rotatably bears said marker means downwardly by gravitational force in operational relationship with the surface to be marked;

said marking means including an elongated marking member including a marking tip in operative relationship with the surface to be marked, said surface to be marked being in a generally horizontal orientation, said marking member being generally vertical;

said holder means being moved in a circular pattern about an imaginary center in said hole;

wherein said holder means further includes swivel means joining said holder means with said gear means, said swivel means being for allowing said holder means to be moved in a horizontal arc which is disposed eccentrically relative to said center of said at least one circle so that said marking member can be moved along said arc to varied distances from said center of said circle, wherein said at least one circle is a plurality of circles of selected radii;

whereby when said system is moved manually relative to the surface, said marking means draws a configuration upon the surface.

2. The system according to claim 1, further including adjusting means connected to said gear means and to said swivel means for engaging said holder means at one of a plurality of engaging positions as said holder means is moved along said horizontal arc, wherein said marking member can be rotated in one of said plurality of circles of selected radius about said center.

3. The system according to claim 1, wherein said holder means is a holder member having a central cylindrical cavity, said marking member being positioned in said cylindrical cavity.

4. The system according to claim 3, wherein said holder member includes a plurality of circular biasable gripping rims in parallel relationship positioned in said holder member, said gripping rims forming said central cylindrical cavity, said marking member being positioned in said cylindrical cavity and being in biased relationship with said gripping rims during operation of the system and is manually removable from said cylindrical cavity.

5. The system according to claim 2, wherein said gear means includes a spur gear configured as a ring rotatably mounted to said housing, said spur gear having inner and outer rims, said outer rim having gear teeth and said inner rim defining a circular hole having a gear center coextensive with said center of said plurality of circles.

6. The system according to claim 5, wherein said gear means further includes a pinion gear axially mounted to said drive means and an intermediate gear rotatably mounted to said housing, said intermediate gear being meshed with said spur gear and with said drive gear.

7. The system according to claim 6, further including a ledge connected to said inner rim of said spur gear, said ledge extending into said circular hole in a plane aligned with the plane of said spur gear, said ledge forming an eccentric groove concentric with said eccentric horizontal arc of said holder member, said eccentric groove including a plurality of looking recesses, said adjusting means including a locking pin capable of being snap mounted into a selected one of said plurality of locking recesses so that said marking can be rotated one of said plurality of circles of selected radius about said center.

8. The system according to claim 7, wherein said holder member and said swivel means are rotatably connected at said pivot means, said pivot means being generally horizontal.

9. The system according to claim 6, wherein said drive means includes a motor mounted in said housing and having a drive shaft, and said power means includes at least one battery mounted in said housing, and electrical circuit between said motor and said at least one battery, and an on/off switch mounted to said housing in operative relationship with said electrical circuit.

10. The system according to claim 1, further including template means connected to said housing, said template means having a cutout with an edge, said marking means being movable in operative relationship with said edge wherein said marking tip is capable of drawing a continuous line upon said surface in coonformity with said edge of said cutout.

11. The system according to claim 10, further including biasing means connected to said gear means in operative contact with said marking means for continuously pressing said marking means against said edge of said cutout.

12. The system according to claim 11, wherein said template means is a template removably connected to said housing under said hole, said cutout being one cutout configuration of a plurality of cutout configurations.

* * * * *